US009072922B2

(12) United States Patent
Cordani

(10) Patent No.: US 9,072,922 B2
(45) **Date of Patent: *Jul. 7, 2015**

(54) FLUID DISPENSING LADDER

(71) Applicant: GelTech Solutions, Inc., Jupiter, FL (US)

(72) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 122 days.

This patent is subject to a terminal disclaimer.

(21) Appl. No.: 13/943,526

(22) Filed: Jul. 16, 2013

(65) Prior Publication Data

US 2014/0209333 A1 Jul. 31, 2014

Related U.S. Application Data

(60) Provisional application No. 61/758,594, filed on Jan. 30, 2013.

(51) Int. Cl.

| | |
|---|---|
| ***A62C 31/24*** | (2006.01) |
| ***A62C 3/00*** | (2006.01) |
| ***E06C 7/00*** | (2006.01) |
| ***A62C 13/78*** | (2006.01) |
| *A62C 3/16* | (2006.01) |

(52) U.S. Cl.

CPC . *A62C 13/78* (2013.01); *A62C 3/00* (2013.01); *E06C 7/00* (2013.01); *A62C 3/16* (2013.01); *A62C 31/24* (2013.01)

(58) Field of Classification Search

CPC ..... A62C 3/00; A62C 31/24; E06C 7/00; A62B 1/00

USPC ..... 169/54, 70, 91; 182/51, 52

See application file for complete search history.

(56) References Cited

U.S. PATENT DOCUMENTS

| | | | | |
|---|---|---|---|---|
| 24,728 | A * | 7/1859 | Fitzgerald | 182/51 |
| 3,090,465 | A * | 5/1963 | Smith | 182/52 |
| 3,485,322 | A * | 12/1969 | Trefz | 182/189 |
| 4,007,793 | A * | 2/1977 | Hux et al. | 169/25 |
| 4,650,034 | A * | 3/1987 | D'Avanzo | 182/49 |
| 4,978,460 | A | 12/1990 | Von Blucher et al. | |
| 5,087,513 | A | 2/1992 | Kim | |
| 5,190,110 | A | 3/1993 | Von Blucher et al. | |
| 5,519,088 | A | 5/1996 | Itoh et al. | |
| 5,849,210 | A | 12/1998 | Pascente et al. | |
| 5,989,446 | A | 11/1999 | Hicks et al. | |
| 6,372,842 | B1 | 4/2002 | Grisso et al. | |
| 6,834,728 | B2 | 12/2004 | Demole | |

(Continued)

*Primary Examiner* — Ryan Reis

(74) *Attorney, Agent, or Firm* — McHale & Slavin, P.A.

(57) ABSTRACT

Disclosed is a safety ladder for protecting a lineman or firefighter from a flash fire. The ladder has the appearance of a conventional ladder but includes interlocking plates positioned in between the rungs along the rails. Attached to the plates are fluid conduits that allow for the dispensing of a hydrated super absorbent polymer having superior fire suppression to be sprayed over an individual using the ladder should a fire erupt. The mounting plates have spray nozzles attached to the conduit located along the rails of the ladder so as to not infer with normal use of the ladder. A pressurized container of hydrated super absorbent polymer is coupled to the ladder. The hydrated super absorbent polymer is discharged through a solenoid valve which can be operated by the individual using the ladder with a button attached to the ladder or activated by a heat sensor attached to the ladder.

23 Claims, 8 Drawing Sheets

(56) References Cited

U.S. PATENT DOCUMENTS

| | | | | |
|---|---|---|---|---|
| 7,096,965 | B2 | 8/2006 | Ozment | |
| 7,104,336 | B2 | 9/2006 | Ozment | |
| 7,124,834 | B2 | 10/2006 | Sundholm et al. | |
| 7,169,843 | B2 | 1/2007 | Smith et al. | |
| 2008/0035354 | A1 | 2/2008 | Cordani | |
| 2014/0299412 | A1 * | 10/2014 | Cordani | 182/51 |

* cited by examiner

FLUID DISPENSING LADDER

REFERENCE TO RELATED APPLICATIONS

This application claims the priority date of provisional Patent Application No. 61/758,594 filed Jan. 30, 2013 entitled "Fluid Dispensing Ladder", the contents of which is incorporated herein by reference.

FIELD OF THE INVENTION

This invention relates to the field of fire prevention, and more particularly to a ladder modification to permit dispersion of a hydrated super absorbent polymer around the ladder should a fire occur.

BACKGROUND OF THE INVENTION

In many cities the utilities are located beneath the surface of the earth, usually beneath the surface of the streets. These utilities are placed in tunnels or conduits. In the older cities, such as New York City, these utilities have been located in conduits for years or even decades. Over time the conduits which carry utilities may wear out and break. Further, electrical lines may simply be used beyond their use life as higher electrical loads are placed upon the lines. A serious problem is the failure of electrical transmission lines. These failures usually result in fires which must be quickly extinguished to prevent damage to the surrounding infrastructure.

While it is desirable to replace very old utilities in conduits and tunnels, it is not always practical. Due to financial restraints and other limitations, most of these electrical transmission lines have not been replaced. Unfortunately, failure of older electrical transmission lines can result in an electrical fire. These fires are commonly discovered when smoke is seen arising from manhole covers in the streets and sidewalks. It has been estimated by Consolidated Edison that there are approximately 40 electrical fires per day under the streets of New York City.

The cost of repairing and replacing the electrical transmission lines damaged by these fires is approximately $100,000.00 per linear foot of transmission line. Therefore, it is imperative that these fires be extinguished as quickly as possible. Inspection of lines can help pinpoint potential trouble areas. Unfortunately, inspection of the lines can trigger a fire. For instance, the opening of a manhole cover can provide the oxygen needed to support a fire. Similarly, a lineman performing an inspection may disturb a conduit resulting in arcing of electric lines, possibly triggering a fire.

Normally a lineman inspecting a potential problem area occurs while electrical power is still flowing through the lines. The inspection takes place within the manhole wherein a lineman inserts himself into the manhole. Typically a ladder is placed through the manhole and the lineman climbs down the ladder to permit inspection from within. Unfortunately the lineman can trigger a fire, or simply be in the wrong place at the wrong time. There have been many instances where a fire begins while the lineman is on the ladder. For instance, a fire may be smoldering as evidence by smoke coming out of the manhole. A lineman or fireman may then enter the manhole, and without notice, the smoldering may burst into an all encompassing fire. In many such instances, the individual who climbed into the manhole is now at risk of injury or death.

Another area of concern is the use of ladders for extracting people from burning buildings. Firemen do not hesitate to lean a ladder against a building to reach the lower floors in an effort to fight fires or extract survivors. Unfortunately such a situation cannot predict if a fire will erupt from a lower floor and engulf the firefighter while he/she is on the ladder. While the firefighter is likely prepared for a flash fire and is appropriately dressed, any survivor that they are pulling down the ladder will not be dressed should a fire approach the ladder area.

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station.

U.S. Pat. No. 7,096,965 discloses a method of proportioning a foam concentrate into a non-flammable liquid to form a foam concentrate/liquid mixture and create a flowing stream of the foam concentrate/liquid mixture. Nitrogen is introduced into the stream of the foam/liquid mixture to initiate the formation of a nitrogen expanded foam fire suppressant. The flowing stream carrying the nitrogen expanded foam is dispensed, which completes the full expansion of the nitrogen expanded foam fire suppressant, into the confined area involved in the fire, thereby smothering the fire and substantially closing off contact between combustible material involved in the fire and the atmosphere.

U.S. Pat. Nos. 7,096,965 and 7,104,336 disclose a method and apparatus for proportioning a foam concentrate into a non-flammable liquid to form a foam concentrate/liquid mixture.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium.

U.S. Patent Publication No. 2008/0035354 is entitled "Water Based Fire Extinguishers", the contents of which are incorporated herein by reference, discloses a process for retarding or extinguishing conflagrations using a super absorbent polymer in water. The reaction of the water with the polymer creates a viscosity that can be readily pumped through a standard water based fire extinguisher, yet viscous enough to cover vertical and horizontal surfaces to act as a barrier to prevent fire from damaging such structures.

U.S. Pat. No. 7,169,843 discloses absorptive, cross-linked polymers which are based on partly neutralized, monoethylenically unsaturated monomers carrying acid groups, and with improved properties, which has a high gel bed permeability and high centrifuge retention capacity.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's.

U.S. Pat. No. 5,849,210 discloses a method of preventing or retarding a combustible object from burning including the steps of mixing water with a super absorbent polymer ("SAP") to form one at least partially hydrated SAP, and applying the at least partially hydrated SAP to the combustible object, before or after combustion.

U.S. Pat. No. 6,372,842 discloses methods of using an aqueous composition or dispersion containing a water-soluble or water-dispersible synthetic polymer, and compositions formed thereof.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for firefighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent.

U.S. Pat. No. 5,519,088 discloses an aqueous gel comprising a polymer of (meth)acrylamide or particular (meth)acrylamide derivative(s), particulate metal oxide(s) and an aqueous medium, a process for producing said gel, and products utilizing said gel.

What is needed is a device for attachment to a ladder that provides fire protection to the immediate area around the ladder without affecting the integrity of the ladder.

SUMMARY OF THE INVENTION

A ladder having provisions for protecting an individual by suppressing a fire in manhole or in an area where a fire may occur, such as in firefighting situations. The ladder includes a kit for strategically positioning spray nozzles for use in distributing a hydrated super absorbent polymer around the ladder in the event of a fire, including the encompassing of any individual. The ladder kit includes mounting plates for attaching a conduit and directional spray nozzles positioned along the rails. The mounting plates are constructed and arranged to be secured to the rails without compromising the structural integrity of the rails without affecting the Occupational Safety and Health Administration (OSHA) compliance granted to the ladder. The hydrated super absorbent polymer can be manually discharged by operating the valve handle at the gel tank or by activating a solenoid, either manually or remotely by use of an electric solenoid triggered by an actuator or triggered by automatically by heat sensors positioned along the ladder. The ladder is preferably constructed from fire resistant and non-conductive materials.

The hydrated super absorbent polymer has substantially superior fire suppression and extinguishing properties than the fire suppression and extinguishing properties of plain water. One of the unique properties of the admixture is its ability to cling to objects to which it has been applied and both cool down the object after it is on fire and create a block to inhibit fire from spreading over the object. The hydrated super absorbent polymer mixture has a viscosity and is distributed in a manner to be contained within a specific area without spreading to adjacent areas. These superior properties enable fires, including electrical fires, to be extinguished more rapidly and not flare back up. The hydrated super absorbent polymer provides a non-conductive environment and the polymer can encapsulate noxious and toxic gases produced by electrical fires. The admixture is capable of retaining ash, particulates, and other byproducts of the electrical fire to enable a rapid and thorough cleanup. The admixture is also capable of protecting an individual's skin from exposure to fire.

Accordingly, it is an objective of the instant invention to provide an improved ladder for use in areas that might be subject to flash fires.

It is a further objective of the instant invention to provide a multipurpose ladder having fire suppression capabilities.

It is yet another objective of the instant invention to provide a ladder for protecting personnel from an electrical fire by providing a means for creating a non-conductive protective barrier around the ladder in the event of a fire.

It is a still further objective of the invention to modify a ladder that is OSHA compliant, and maintain that compliance by use of nondestructive fasteners for use in attaching the fire suppression device.

It is a further objective of the present invention to provide a ladder having strategically positioned spray nozzles and a volume of fire suppression material calculated to provide the individual time to extract themselves from the manhole.

It is still a further objective of the present invention to provide an individual a means to activate the system from any point on the ladder.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
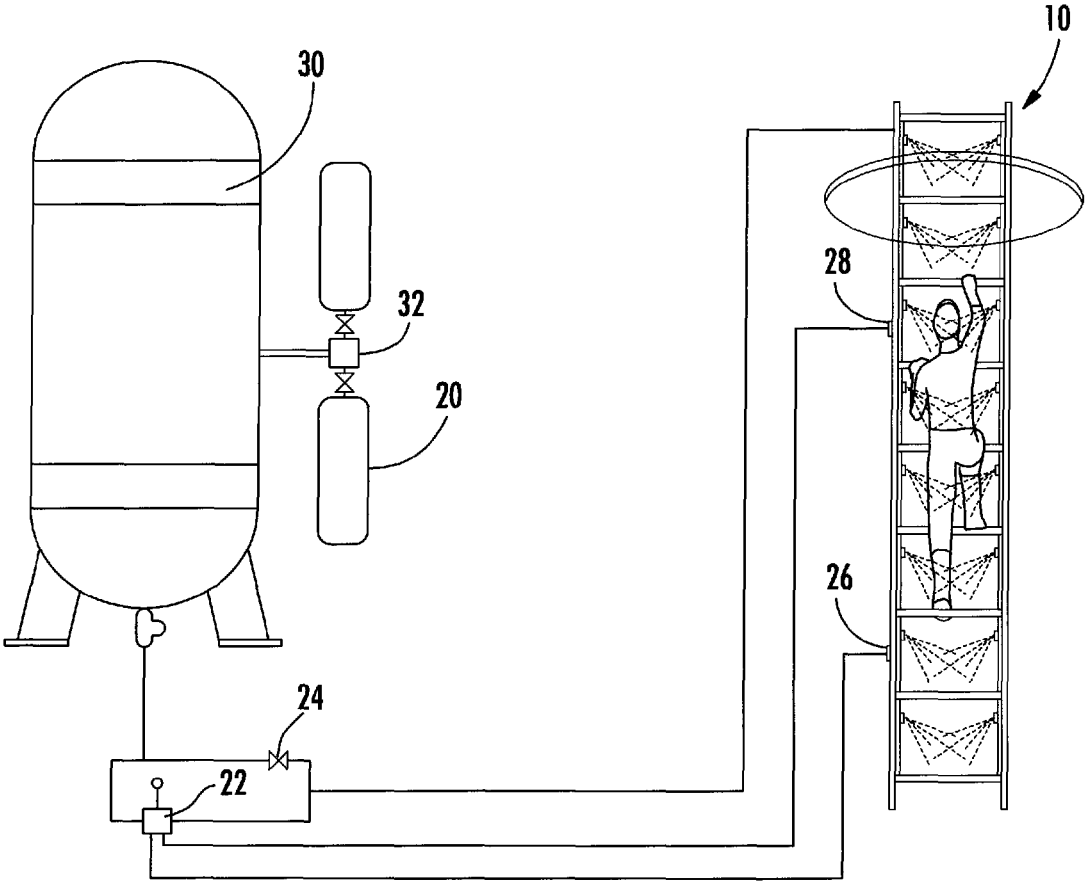
FIG. 1 is a pictorial view of the present invention.
Figure 2:
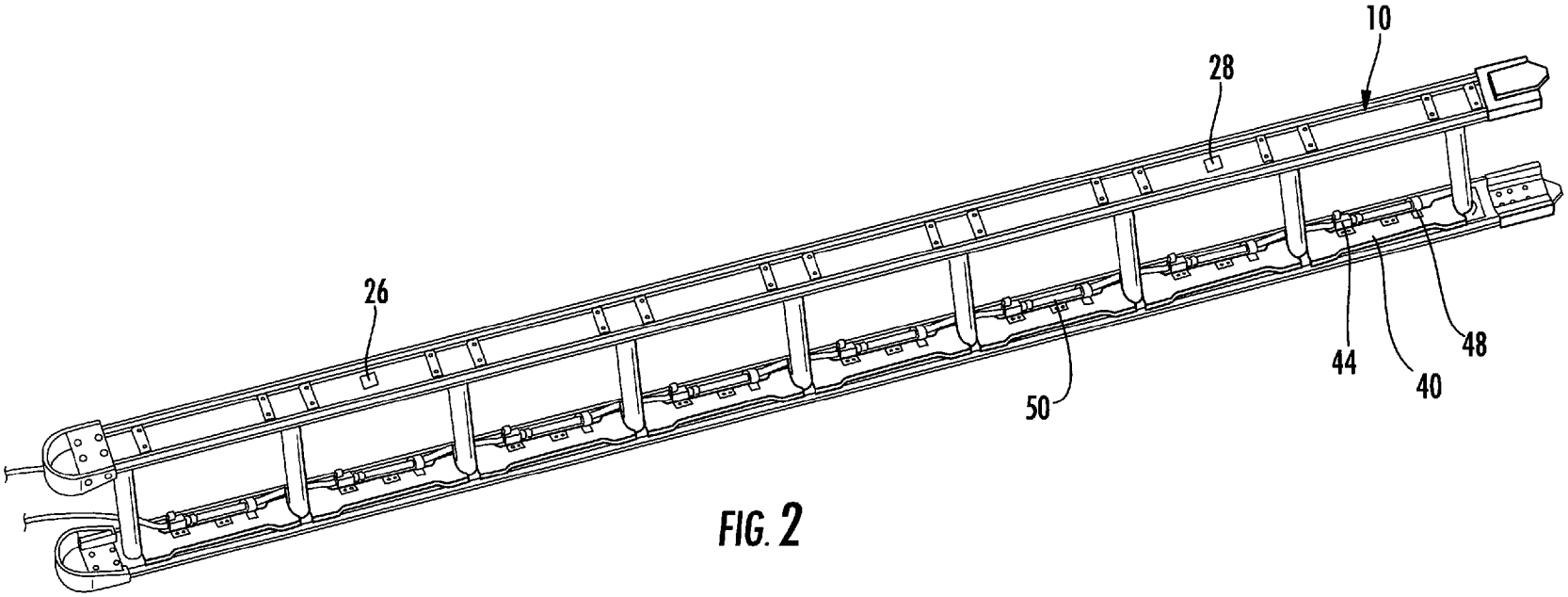
FIG. 2 is a side perspective view of the fluid dispensing kit installed on a ladder.
Figure 3:
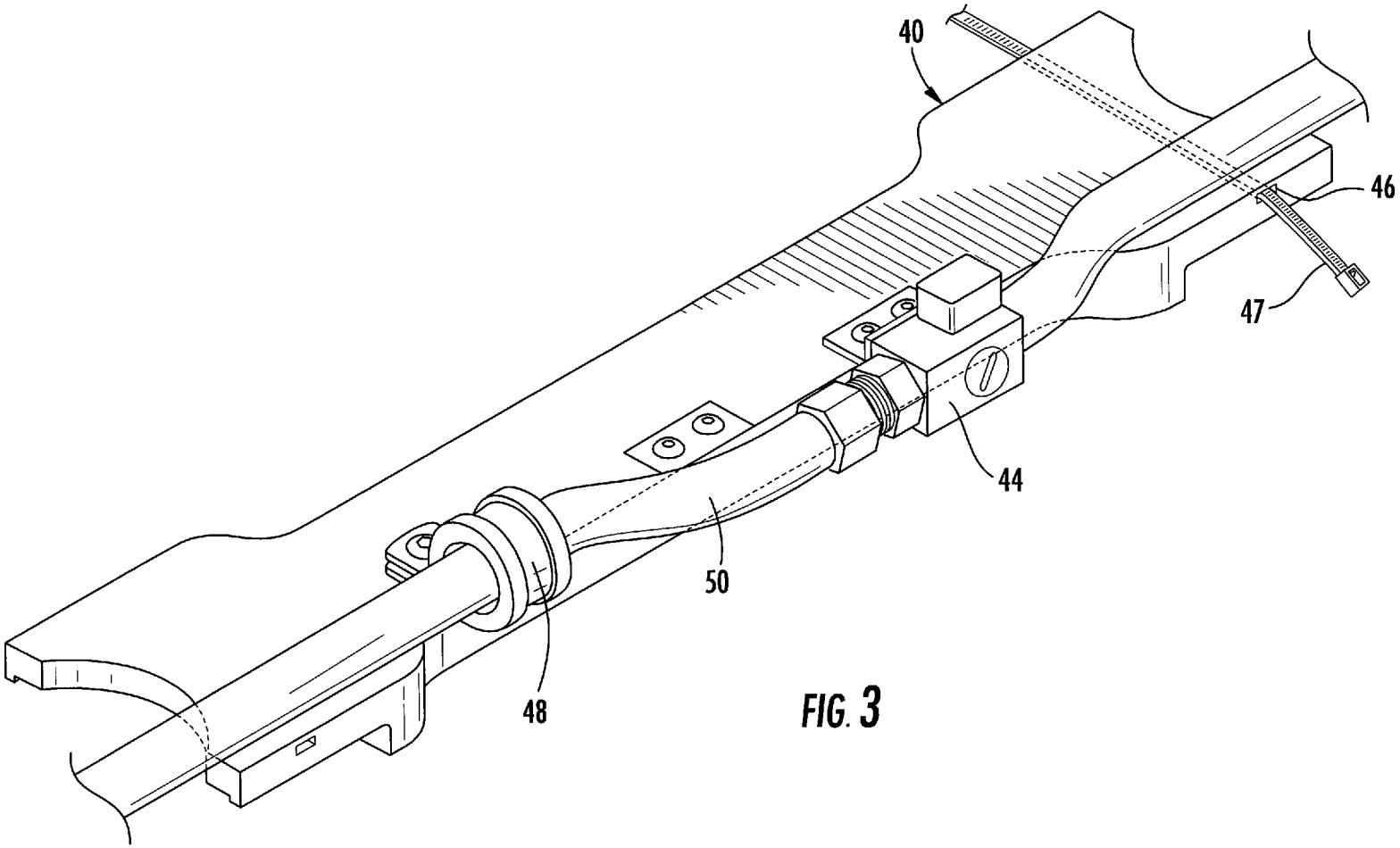
FIG. 3 is a top perspective view of the mounting plate.
Figures 4A, 4B:
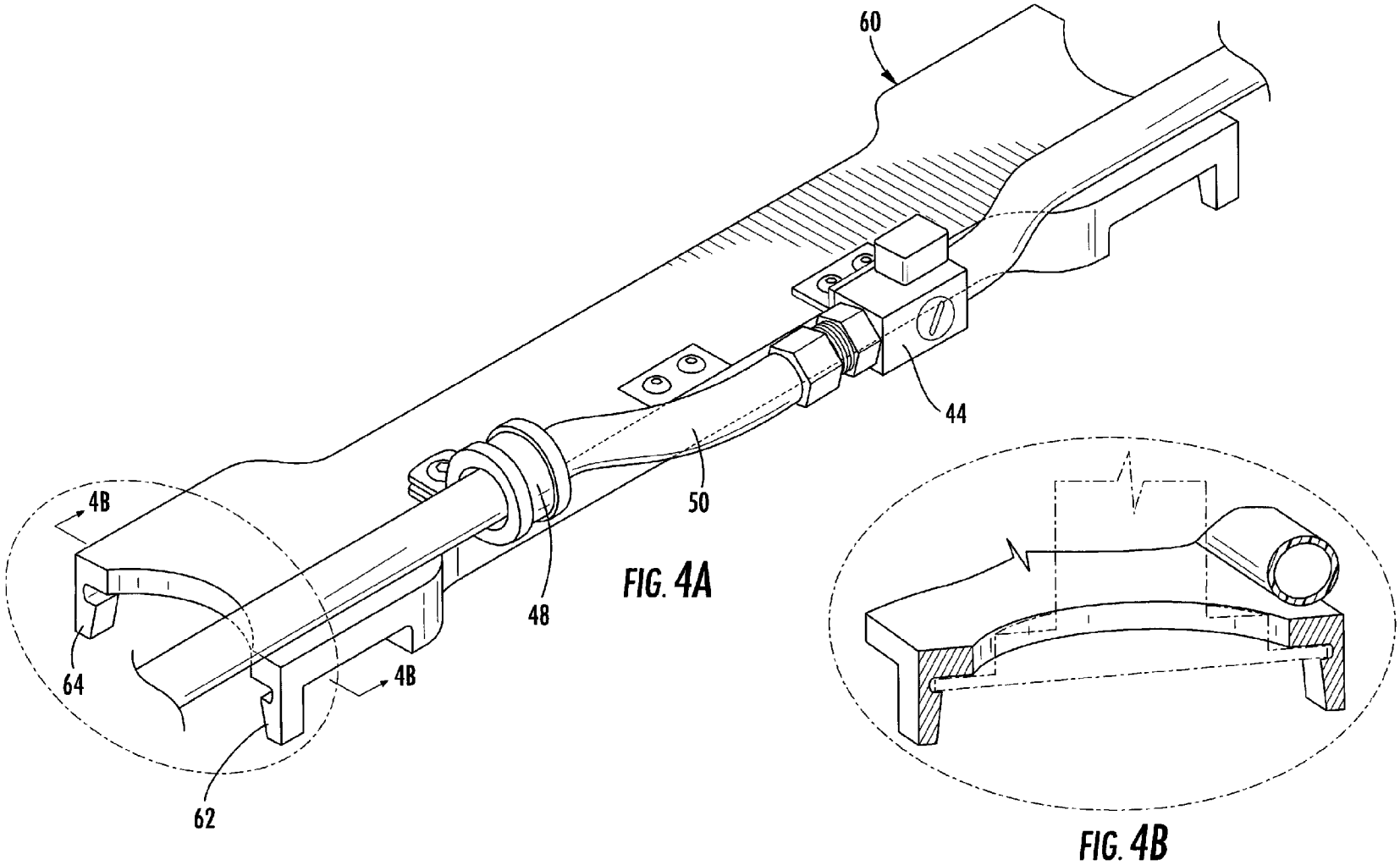
FIG. 4A is a top perspective view of an alternate embodiment of the mounting plate.
FIG. 4B is a front perspective view as viewed along line 4B-4B of FIG. 4A.
Figure 5A:
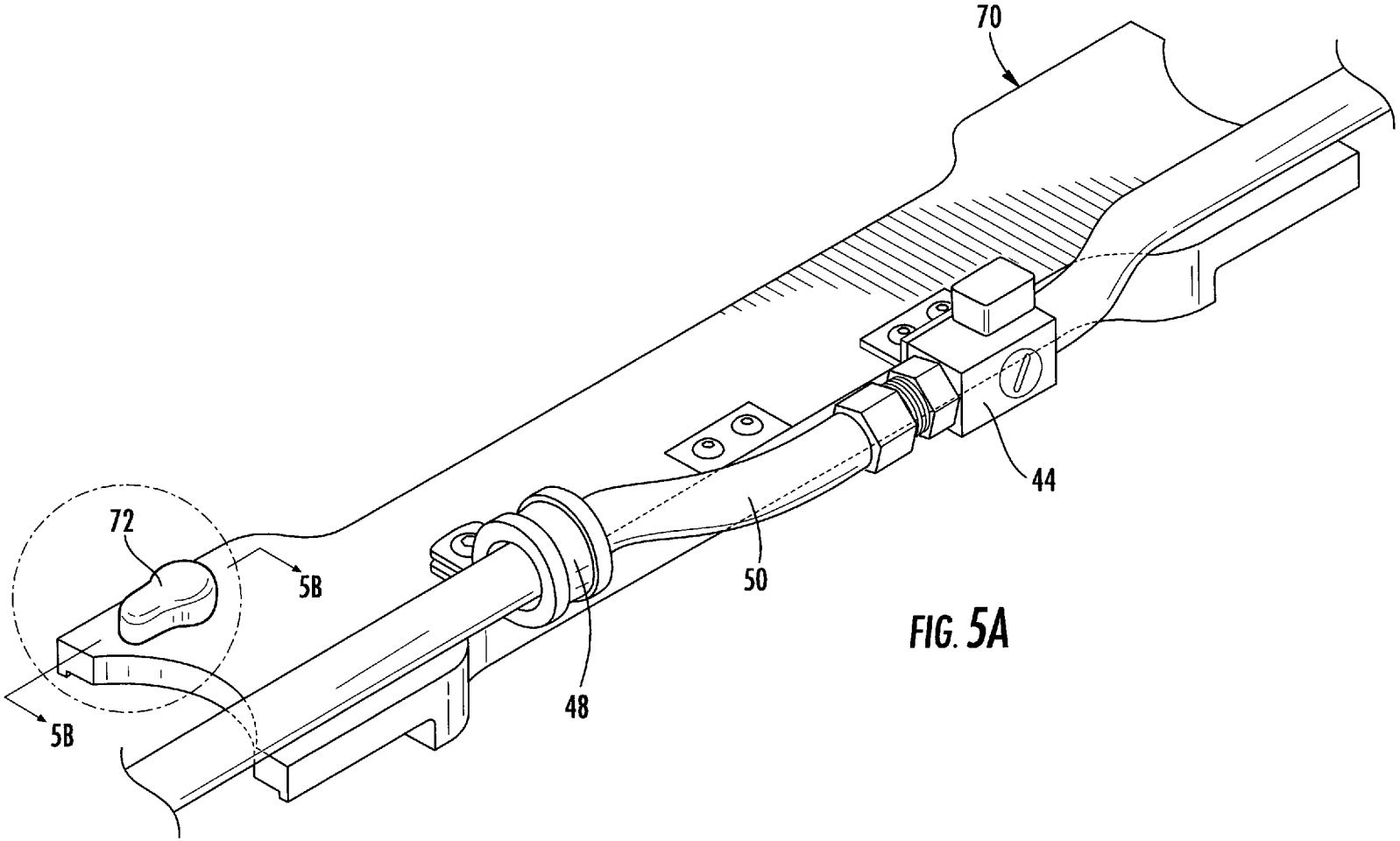
FIG. 5A is a top perspective view of an alternate embodiment of the mounting plate.
Figure 5B:
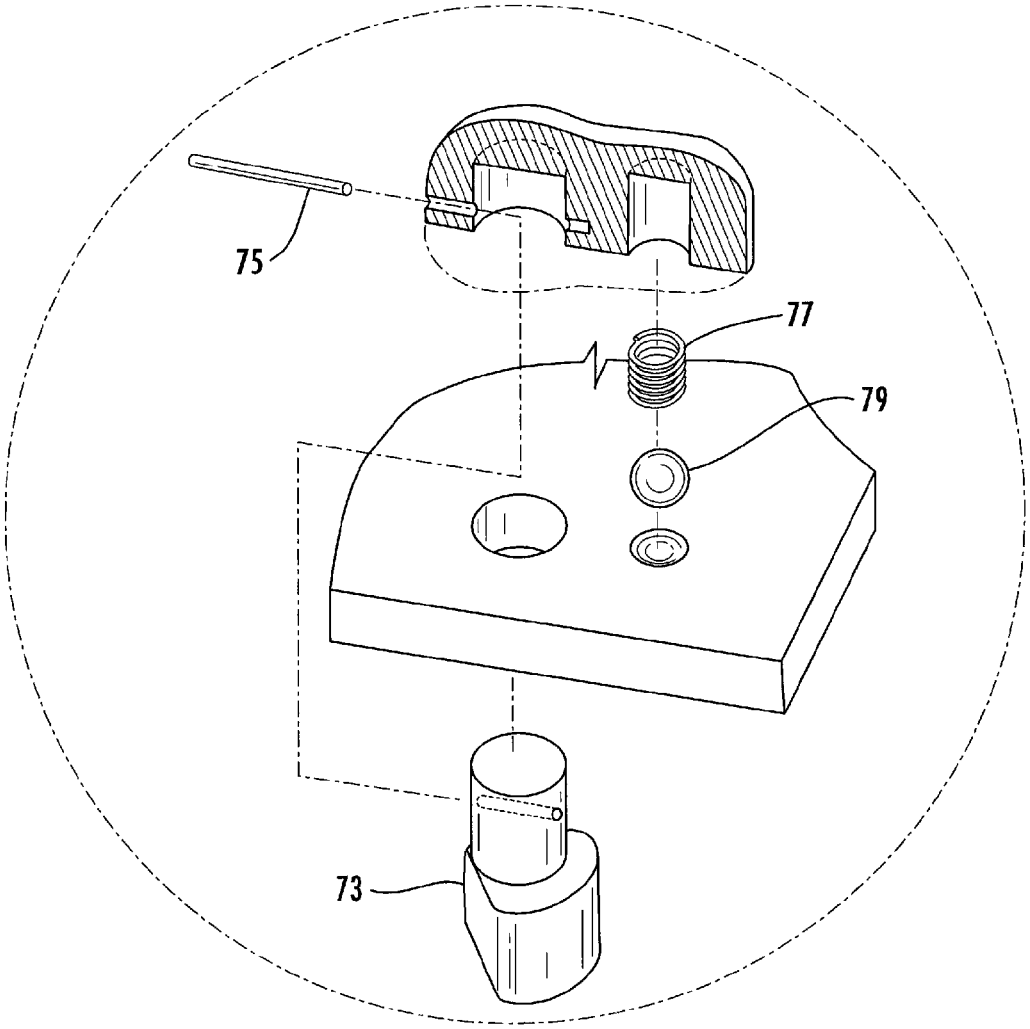
FIG. 5B is an exploded cross sectional view as viewed along line 5B-5B of FIG. 5A.
Figure 6:
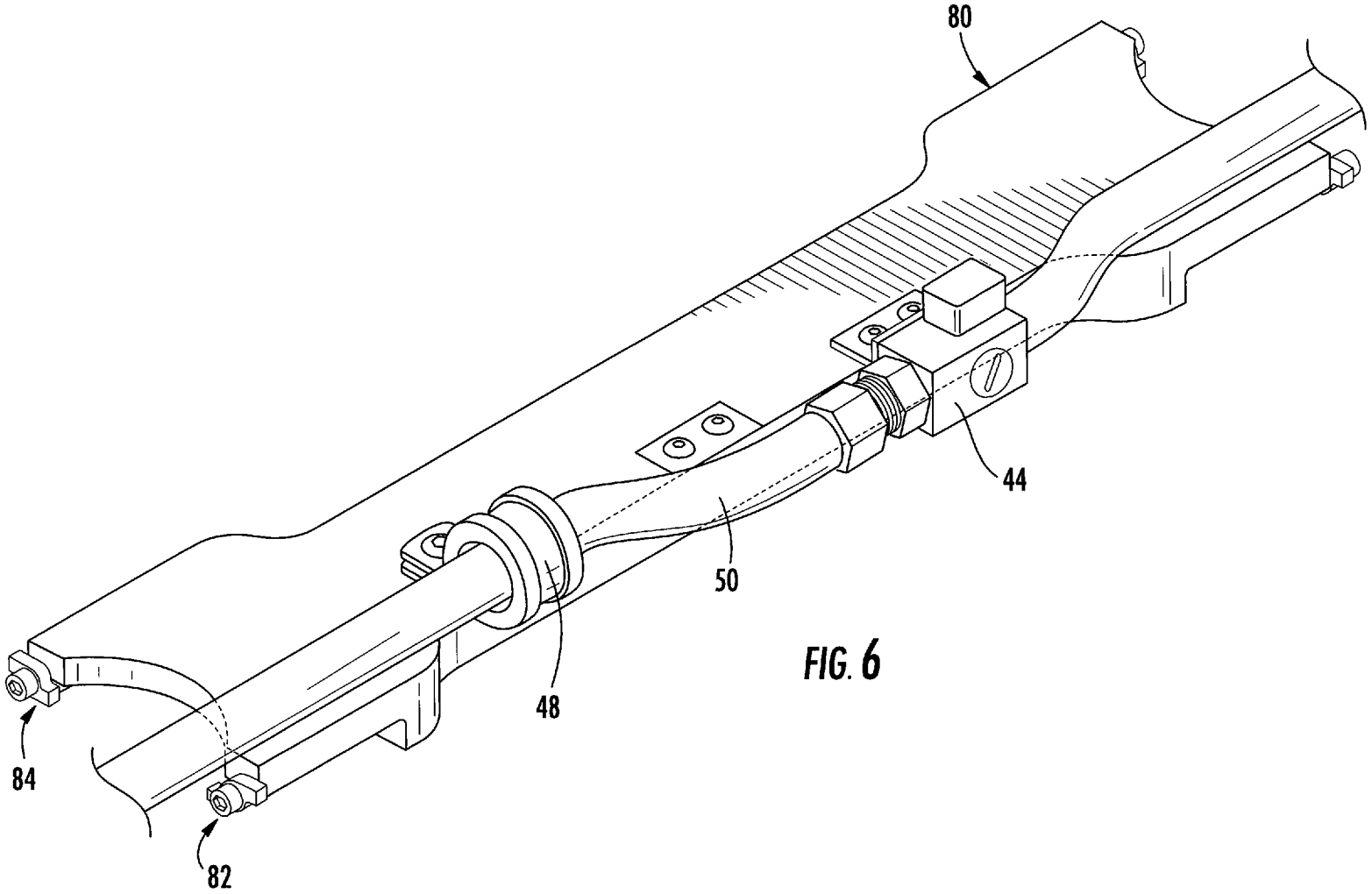
FIG. 6 is a top perspective view of an alternate embodiment of the mounting plate.
Figure 7:
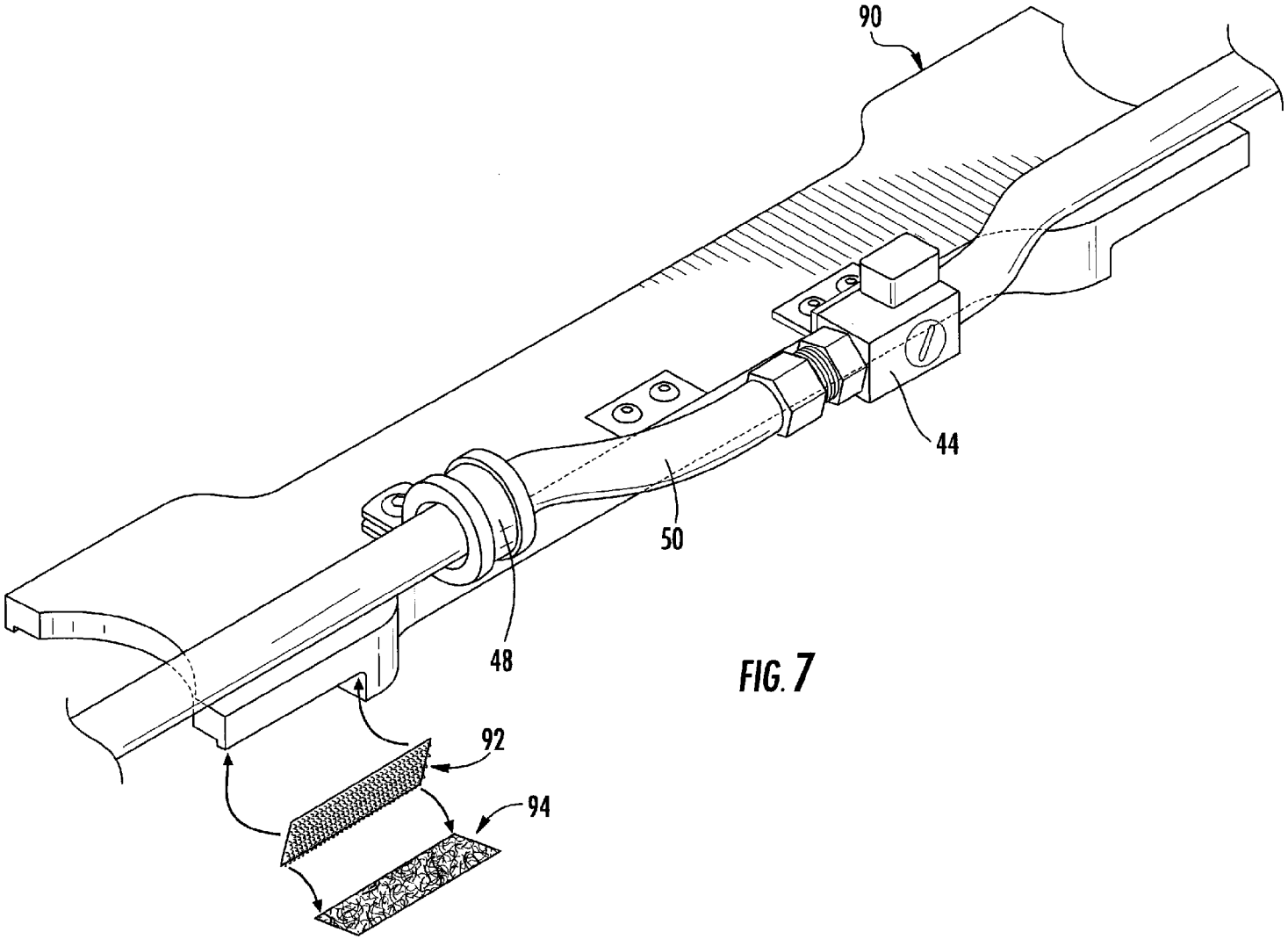
FIG. 7 is a top perspective view of an alternate embodiment of the mounting plate.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to a unique technique for suppressing fires. This unique technique utilizes a super absorbent polymer in water in an amount sufficient to suppress or extinguish an electrical fire. The present invention utilizes biodegradable, super absorbent, aqueous based polymers. Examples of these polymers are cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyaminoacids.

Referring to the Figures, the present invention is a fluid dispensing kit for installation on a ladder 10 which can be used to protect personnel that are within a manhole or otherwise in a position where a flash fire may occur. Electrical fires present different and unique problems pertaining to how these fires should be suppressed. Water is normally used to fight fires because it can quickly cool down the burning material. However, water and electricity are harmful, if not deadly to individuals, when brought into contact with each other. Normally, when water hits an active electrical circuit, it shorts out the circuit which usually results in destruction of the circuit. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water. Metal ladders provide an excellent conductor and, despite the resistance to fire, should not be used where live electrical wires exist.

In the preferred embodiment of the present invention, a gel form of the hydrated super absorbent polymer, are utilized having properties which enable the hydrated super absorbent polymer when applied to remain within the confined area because of its relatively high viscosity. The properties of the gel, in particular its viscosity, also enable the gel when applied to remain on vertical, horizontal, and curved surfaces of the ladder used by the individual to enter the manhole or other situations where a fire may occur. Unlike pure water, the material does not provide an electrically conductive path permitting the individual time to get out of the manhole without being electrocuted directly or indirectly should a metallic ladder be employed. The present invention adds a predetermined amount of the super absorbent polymer to a predetermined amount of water to obtain an admixture which has properties that enable the admixture to suppress the spread of an electrical fire and extinguish any fire that has attached itself to the individual. The preferred predetermined amounts are 2-4 pounds of dry super absorbent polymer to 30 gallons of water. The super absorbent polymer can be added to a given volume of water and the resulting admixture pumped to a location to suppress the spread of and extinguish electrical fires. The adherence of the admixture of super absorbent polymer and water to the clothing of the individual lowers the temperature of the clothing below a combustion temperature thereby giving the individual time to exit the manhole. In addition, adherence of the admixture of super absorbent polymer and water to the clothing maintains moisture content at a level which suppresses the spread of the fire by preventing combustion of the clothing from hot embers and/or flames. Further, placing the admixture upon exposed skin deters burning of the skin.

Currently, firefighters apply water to the electrical conduits/components which are on fire and also to adjacent conduits/components. Because it is difficult to control where the water goes, the contact of water on electrical conduits/components which are not on fire results in substantial unnecessary damage to these conduits/components. The present invention, on the other hand, enables a controlled dispersion of super absorbent polymer water mixture to a specific area for the primary purpose of protecting the individual from the fire, and giving the individual time to escape the manhole. The mixture adheres to the individual and the ladder, without affecting adjacent conduits/components. Thus, a substantial safety factor is gained because electrical conduits/components are not sprayed and, if they are sprayed, the admixture is not conductive like water.

Besides the risk of electrocution from using only water to protect an individual in an electrical fire, water will not suppress the noxious and/or toxic gases produced by burning electrical wires, insulation and other components. However, the admixture of super absorbent polymer and water of the present invention has physical and chemical properties which enable the admixture to entrap and retain the noxious and/or toxic gasses and prevent the release of these gases into the atmosphere. This is an important advantage that the present invention has over the prior art because it prevents the noxious and/or toxic gases from reaching and affecting the individuals during the time needed to escape the fire.

Referring now to the Figures, disclosed is a ladder 10 comprised of a pair of spaced parallel rails coupled together by a plurality of spaced apart transverse rungs. The rails include an inner and an outer surface and at least one of the inner and outer surfaces include a channel extending along the length thereof.

The invention is a fluid dispensing kit constructed and arranged to provide fire suppression and personal protection for an individual on the ladder. The kit is comprised of at least one mounting plate 40 with a means for securing the mounting plate to the channel positioned in between the rungs.

In order to comply with the Occupational Safety and Health Administration (OSHA) standards, the structural integrity of the rails cannot be compromised. In a preferred embodiment, the means for securing the mounting plate 40 includes a flow through aperture 46 constructed and arranged to cooperate with a zip tie 47 to secure the mounting plate 40 to the rungs. In an alternative embodiment 60, the means for securing the mounting plate includes clips 62, 64 having a substantially conjugate shape as the rungs constructed and arranged to interlock with the rungs. The means for securing the mounting plate include but are not limited to a ball detent capture mechanism 77, 79, a cam clamp mechanism 73, 75, a torsion spring mechanism 82, 84, a hook and loop mechanism 92, 94, a bonding material, resistance welding straps, and adhesive tape.

In a preferred embodiment, the mounting plate 40 is constructed of an ultra-high molecular weight plastic and is integrally formed. However, any suitable non-conductive material can be utilized and not deviate from the scope of the invention.

A plurality of spray nozzles are secured to the mounting plates and fluidly coupled to the fluid conduit. The nozzles 44 are positioned to create overlapping spray patterns so that the entire ladder is covered with the spray containing the gel to protect someone ascending the ladder during a fire.

There is at least one fluid conduit 50 that extends along the length of one of the channels is secured by at least one clamp 48. The clamp 48 is fixedly attached to the mounting plate 40. In a preferred embodiment, a fluid conduit 50 extends along the length of each of the channels and is secured by a plurality of clamps 48. The plurality of clamps 48 are fixedly attached to a plurality of mounting plates 40. The fluid conduit 50 is comprised of a non-conductive material.

The system includes at least one container 30 having a predetermined amount of hydrated super absorbent polymer. The container has an outlet that includes at least one valve positioned in the line. In a preferred embodiment, the container outlet line comprises a solenoid valve and a manually operated bypass valve. The outlet of the container is fluidly coupled to the fluid conduit 50. In a preferred embodiment, the container is coupled to the conduit with a hose that cooperates with a quick connect device.

There is at least one valve positioned in the discharge side of the container, this is a solenoid 22 operated by a push button 26 positioned on the ladder 10 electrically coupled to the solenoid 22, whereby a person can discharge the hydrated super absorbent polymer from the ladder. The solenoid 22 can also be operated by a heat sensor 28 positioned on the ladder electrically coupled to the solenoid 22. The sensor 28 is positioned to sense the heat from the arc flash in the case of an electrical fire. In a preferred embodiment, the heat sensor 28 is a fixed temperature detector with no thermal lag.

The discharge side of the container 30 also has a manually operated bypass valve 24 that can be operated by an individual that is not on the ladder. In a preferred embodiment, the manually operated bypass valve 24 is spring operated mechanism that fails closed. This is to insure that the container 30 is not accidentally discharged as the bypass valve requires an operator to hold it open.

At least one propellant tank 20 having a predetermined amount of compressed gas is coupled to the container with a gas conduit. A valve is positioned in the gas conduit between the propellant tank 20 and the container 30. The valve is manually operable to allow gas to charge the hydrated super absorbent polymer in order to be delivered to the plurality of spray nozzles 44. In a preferred embodiment, the container 30 is always charged with compressed gas.

A regulator 32 is positioned in the gas conduit to allow the gas to flow at a predetermined pressure. In a preferred embodiment, the gas is supplied at a predetermined pressure and volume to allow the admixture of super absorbent polymer to discharge at a rate to provide coverage in with the spray pattern for a time sufficient for someone to ascend the ladder in case of a fire. It is contemplated that two minutes of discharge of the admixture of super absorbent polymer would be sufficient however a longer or shorter duration could be utilized without deviating from the scope of the invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A fluid dispensing kit for use with a ladder assembly formed from a pair of rails constructed from a non-conductive material having a inner and an outer surface and each rail having a channel portion spaced apart and extending longitudinally along said inner surface to receive a plurality of transverse rungs extending between said inner surfaces of opposing rail channels, said fluid dispensing kit comprising;

mounting plates constructed and arranged to fit in said channel and between adjacent rungs along said inner surface of said rails;

a conduit extending along a length of said rail and secured to said mounting plates;

a least one spray nozzle fluidly coupled to said conduit;

a storage container coupled to said conduit, said storage container holding a predetermined amount of hydrated super absorbent polymer;

a control valve positioned between said pressurized storage container and said conduit, said control valve operable to allow said hydrated super absorbent polymer to be delivered to said spray nozzles through said conduit for dispensing about said rails.

2. The fluid dispensing kit for use with a ladder assembly according to claim 1 wherein said storage container is pressurized with a compressed gas.

3. The fluid dispensing kit for use with a ladder assembly according to claim 2 wherein said nozzles are arranged to provide overlapping spray patterns of said hydrated super absorbent polymer.

4. The fluid dispensing kit for use with a ladder assembly according to claim 1 wherein mounting plates have a substantially conjugate shape to interlock between adjacent rungs.

5. The fluid dispensing kit for use with a ladder assembly according to claim 1 wherein said mounting plates include an aperture for receipt of a zip tie allowing attachment to said rail without breaching said rail.

6. The fluid dispensing kit for use with a ladder assembly according to claim 1 wherein said mounting plates are secured to said rails by a fastener selected from the group of: ball detent capture mechanism, torsion spring mechanism, hook and loop attachment, cam clamp mechanism, bonding material, resistance welding straps or an adhesive tape.

7. The fluid dispensing kit for use with a ladder assembly according to claim 1 wherein said mounting plates are constructed from a non-conductive material.

8. The fluid dispensing kit for use with a ladder assembly according to claim 1 wherein said valve includes an electrically actuated solenoid operated by an electric actuating switch attached to the ladder.

9. The fluid dispensing kit for use with a ladder assembly according to claim 8 wherein said electric actuating switch is manually operated.

10. The fluid dispensing kit for use with a ladder assembly according to claim 8 wherein said actuating switch is operated upon the presence of high temperatures.

11. The fluid dispensing kit for use with a ladder assembly according to claim 1 wherein said valve includes an electrically actuated solenoid operated by an actuating switch positioned remote to the ladder.

12. The fluid dispensing kit for use with a ladder assembly according to claim 1 wherein said valve is a manually operated ball valve.

13. A fluid dispensing kit for use with a ladder assembly formed from a pair of rails constructed from a non-conductive material having a inner and an outer surface and each rail having a channel portion spaced apart and extending longitudinally along said inner surface to receive a plurality of transverse rungs extending between said inner surfaces of opposing rail channels, said fluid dispensing kit comprising;

mounting plates constructed from a non-conductive material having a conjugate shape and a means for fastening to said channel between adjacent rungs;

a conduit extending along a length of said rail and secured to said mounting plates;

a least one spray nozzle fluidly coupled to said conduit;

a pressurized storage container coupled to said conduit, said storage container holding a predetermined amount of hydrated super absorbent polymer;

an electrically actuated solenoid valve positioned between said pressurized storage container and said conduit, said solenoid valve operable to allow said hydrated super absorbent polymer to be delivered to said spray nozzles through said conduit for dispensing about said rails.

14. The fluid dispensing kit for use with a ladder assembly according to claim 13 wherein said nozzles are arranged to provide overlapping spray patterns of said hydrated super absorbent polymer.

15. The fluid dispensing kit for use with a ladder assembly according to claim 13 wherein said fastening means is a zip tie that is secured through a mounting plate aperture and an adjacent rung.

16. The fluid dispensing kit for use with a ladder assembly according to claim 13 wherein said fastening means is a ball detent capture mechanism.

17. The fluid dispensing kit for use with a ladder assembly according to claim 13 wherein said fastening means is a hook and loop attachment.

18. The fluid dispensing kit for use with a ladder assembly according to claim 13 wherein said fastening means is a cam clamp mechanism.

19. The fluid dispensing kit for use with a ladder assembly according to claim 13 wherein said fastening means is a resistance welding strap.

20. The fluid dispensing kit for use with a ladder assembly according to claim 13 wherein said solenoid valve is operated by an electric actuator secured to said ladder.

21. The fluid dispensing kit for use with a ladder assembly according to claim 13 wherein said solenoid valve is operated upon the presence of high temperatures.

22. The fluid dispensing kit for use with a ladder assembly according to claim 13 wherein said solenoid valve is operated by an actuating switch positioned remote to the ladder.

23. The fluid dispensing kit for use with a ladder assembly according to claim 13 wherein said solenoid includes an RF receiver and said actuating switch is an RF transmitter.

* * * * *